United States Patent [19]

Davis

[11] Patent Number: 4,780,076

[45] Date of Patent: Oct. 25, 1988

[54] POWER BURNER

[75] Inventor: Robert E. Davis, Mountain Home, Ark.

[73] Assignee: Arkansas Patents, Inc., Mountain Home, Ark.

[21] Appl. No.: 936,249

[22] Filed: Dec. 1, 1986

Related U.S. Application Data

[63] Continuation-in-part of Ser. No. 785,433, Oct. 11, 1985, Pat. No. 4,637,792, which is a continuation-in-part of Ser. No. 666,458, Oct. 30, 1984, Pat. No. 4,569,310, which is a continuation-in-part of Ser. No. 403,769, May 26, 1982, which is a continuation-in-part of Ser. No. 218,849, Dec. 22, 1980, Pat. No. 4,479,484.

[51] Int. Cl.[4] ..... F23C 11/04

[52] U.S. Cl. ..... 431/1; 122/24

[58] Field of Search ..... 431/1; 122/24; 126/391, 126/110 B

[56] References Cited

U.S. PATENT DOCUMENTS

| | | | |
|---|---|---|---|
| 2,077,323 | 4/1937 | Hendrix | 122/17 |
| 2,634,804 | 4/1953 | Erickson | 431/1 |
| 2,715,390 | 8/1955 | Tenney et al. | 122/24 |
| 2,898,978 | 8/1959 | Kitchen et al. | 431/1 |
| 4,480,985 | 11/1984 | Davis | 431/1 |
| 4,550,711 | 11/1985 | Griffiths | 126/391 |

*Primary Examiner*—Margaret A. Focarino

*Attorney, Agent, or Firm*—Thomas W. Speckman; Ann W. Speckman

[57] ABSTRACT

A power combustion device comprising an elongate combustion chamber having an inlet for a combustible mixture and an unvalved outlet for combustion gases; an open flow valve distributor member mounted in fixed relation in a wall of the combustion chamber which has a first side in communication with the combustion chamber and a second side in communication with a controlled supply of pressurized combustible mixture with a pluralilty of ports through the valve distributor member directing the combustible mixture along the periphery of the combustion chamber, a pump for premixing and supplying a controlled pressurized combustible mixture to the second side of the floating valve member, and an ignition system for igniting and combusting the combustible mixture in the combustion chamber. The power combustion device provides premixing of fuel and oxidizing gas to form a combustible mixture thereby allowing sealed combustion with respect to the surrounding atmosphere.

20 Claims, 3 Drawing Sheets

POWER BURNER

CROSS REFERENCE TO RELATED APPLICATIONS

This application is a continuation-in-part application to my pending allowed application, Ser. No. 785,433, filed Oct. 11, 1985, now U.S. Pat. No. 4,637,792 which is a continuation-in-part of my earlier filed application, Ser. No. 666,458, filed Oct. 30, 1984, now U.S. Pat. No. 4,569,310, which is a continuation-in-part of my earlier filed application, Ser. No. 403,769, filed May 26, 1982 from International Application No. PCT/US81/001727, filed Dec. 22, 1981, now U.S. Pat. No. 4,488,865, which is a continuation-in-part of my earlier filed application, Ser. No. 218,849, filed Dec. 22, 1980, now U.S. Pat. No. 4,479,484.

BACKGROUND OF THE INVENTION

1. Field of the Invention

The invention disclosed herein pertains generally to improvements in combustors or burners and more particularly relates to controlled pressurized combustable mixture supply power burners for high efficiency combustion and high efficiency heat transfer to the exterior of the burner or the load.

2. Description of the Prior Art

A vast number of burner arrangements are known for a virtually limitless number of specific uses. Typically, combustion takes place in an open combustion zone with the combustion gases then passed through a heat exchanger to heat a fluid such as air or water. Conventional combustion devices are unsatisfactory since oftentimes combustion is incomplete producing various pollutants and furthermore because the efficiency obtainable from such combustion devices is relatively poor.

My earlier allowed applications, Ser. Nos. 785,433 and 875,299, and my earlier issued U.S. Pat. Nos. 4,569,310; 4,488,865; 4,480,985 and 4,479,484, all assigned to a common assignee, disclose prior art principally related to pulsing combustion. These prior applications and patents are incorporated herein by reference in their entireties including the prior art cited therein.

The need exists for an improved burner which provides an efficient and economical use of fuel. Such an improved burner would have particular utility in steam generation devices and in home heating equipment especially where a fluid is to be heated by the combustion. Such an improved burner would be particularly attractive if the same apparatus could be used by easy modification both as a pulsing combustor and as an open flow power burner.

SUMMARY OF THE INVENTION

It is an object of the present invention to provide an improved combustion device which may be operated as a pulsing combustor or as a controlled pressurized combustible mixture supply open flow power burner in the flow of combustible mixture to the combustion chamber.

It is another object of the present invention to provide a pulsing combustion device which provides an efficient and economical use of fuel and which may be converted to a controlled pressurized combustible mixture supply open flow power burner by maintaining a floating valve member in its extreme open flow position.

Yet another object of the present invention is to provide a heating device having a controlled pressurized combustible mixture supply open flow power combustion device wherein the combustion gases heat either a liquid or a gas, which liquid or gas cools the shell of the burner.

It is still another object of the present invention to provide a heating system in which sealed or controlled pressurized combustible mixture supply combustion is effected with less than 15 percent excess air in a hollow flame along the periphery of the combustion chamber and the spent gases of combustion are utilized to improve the efficiency of the system.

A power burner combustion device according to the present invention comprises a combustion chamber with an inlet for controlled pressurized combustible mixture and an unvalved outlet to the atmosphere for combustion gases. The unvalved outlet is sized for the size and geometry of the combustion chamber as more fully explained in my earlier patent applications and patents with respect to pulse combustion. A controlled pressurized combustible mixture of fuel and oxidizer is supplied to one side of an open flow valve or distribution means with through ports of the same geometry as described with respect to the floating valve in my prior patent applications and patents for direction of the combustible mixture along the periphery of the combustion chamber. For power burner use the open flow valve or distribution means is maintained in open flow position to provide open controlled communication between the supply of the pressurized combustible mixture and the periphery of the combustion chamber. The open flow valve member as used for power combustion may be easily converted to a floating valve member which increases and decreases the flow of combustible mixture into the combustion chamber for pulse combustion. The combustible mixture is ignited and burned as a hollow flame along the periphery of the combustion chamber.

The power combustor of the present invention is especially useful in any type of a fluid heating system, such as a home heating or hot water heating system. Present home heating systems with atmospheric type burners require about 40 percent to about 60 percent excess air and are often large and expensive as well as being energy-inefficient because much of the heating value of the fuel is wasted. The controlled pressurized combustible mixture supply open flow power burner of the present invention provides a combustion chamber which is sealed from the fluid heating media and from the ambient air surrounding the burner. The combustion air supply may be drawn from the exterior of the building and mixed with fuel to form a controlled pressurized combustible mixture and the flue gas exhausted to the exterior of the building. The power burner of this invention is especially suited for this type of operation since it requires less than 20 percent excess combustion air, about 10 to about 15 percent being preferred. It is advantageous to provide a building heating system in which a simple and compact controlled pressurized combustible mixture supply open flow power burner having the configuration of a pulsing combustion device wherein a floating valve is maintained in its open flow position is used to enhance heat transfer to the fluid medium by which the home is heated. This provides a more efficient heat transfer and cool flue gas system, since in many of today's home heating systems a large percentage of the heat generated is lost through the chimney. A building heating system using the power burner of this invention efficiently utilizes heat energy contained in the combustion gases produced by the burner.

My U.S. Pat. Nos. 4,488,865, 4,480,985, and 4,479,484 teach specific embodiments of my pulsing combustion device and process. My U.S. Pat. No. 4,569,310 teaches specific embodiments of a fluid heating device incorporating my pulsing combustion device. My allowed U.S. patent applications teach specific embodiments for hot air furnaces.

Heating devices for a wide variety of purposes according to the present invention may use a controlled pfessurized combustible mixture supply power burner device which may be readily convertible to a pulsing combustion device as described either submerged in a fluid or having a flow of fluid, either liquid or gas, encircling the combustion chamber so that the fluid is heated. Heat exchange may be enhanced by placement of baffles in and/or downstream of the combustion zone and combustion products may be passed through a wide variety of coil and/or finned heat exchangers. Likewise, the fluid to be heated may be passed through coil and/or finned heat exchangers. A particularly suitable controlled pressurized combustible mixture supply open flow valve and distribution means is described.

BRIEF DESCRIPTION OF THE DRAWINGS

Preferred embodiments of a controlled pressurized combustible mixture supply power burner combustion device and preferred embodiments of heating devices including the power burner combustion device, according to the present invention are described with reference to the accompanying drawings wherein like members bear like reference numerals and wherein.

DESCRIPTION OF THE PREFERRED EMBODIMENTS

Figure 1:
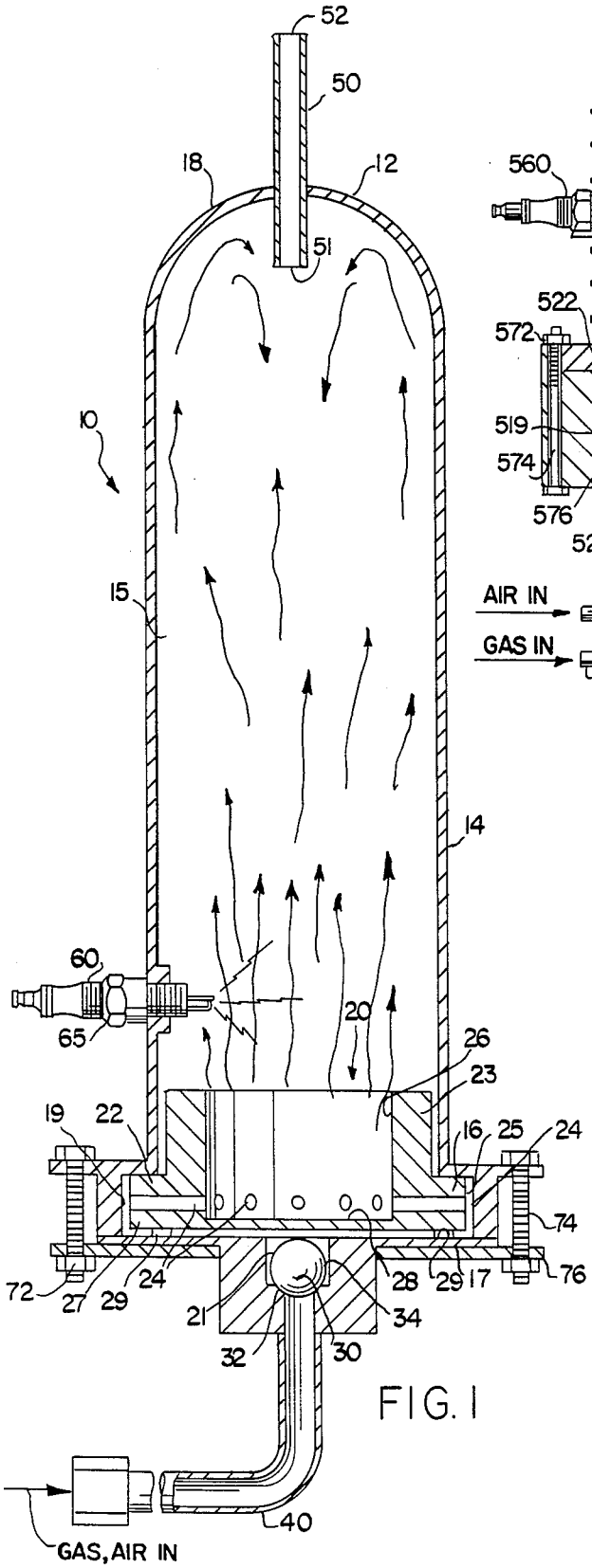
FIG. 1 is a cross-sectional view of one embodiment of a power burner which is convertible to a pulsing combustion device according the present invention.

With reference to FIG. 1, one embodiment of a controlled pressurized combustible mixture supply power open flow combustion device 10, includes an elongate combustion chamber shell or burner shell 14 which defines a combustion chamber 15. The combustion chamber shell 14 is generally tubular with a length that is considerably greater than its width. The combustion chamber shell is preferably circular in cross section, but may of course be square, rectangular or of any other suitable configuration. The combustion chamber 15 is closed except for the outlet for combustion gases and the inlet for admitting the pressurized combustible mixture. The controlled pressurized combustible mixture may be supplied by a line 40 through a ball valve chamber 34 by way of an open flow valve or distribution means 20. Not shown in FIG. 1 is any suitable means for controlled mixing combustible gas and combustion air and pressurizing the combustible mixture for supply to supply line 40. Supply pressures in the order of about 1 to about 3½ inches water column are suitable, about 1 to about 2½ inches water column being preferred for most efficient operation. Ball valve chamber 34 is provided within an end cap 17 disposed at an inlet end of the combustor shell 14. After combustion, the combustion gases exit through an open exhaust tube 50 disposed at an exhaust end 18 of the combustor shell 14.

Figure 2:
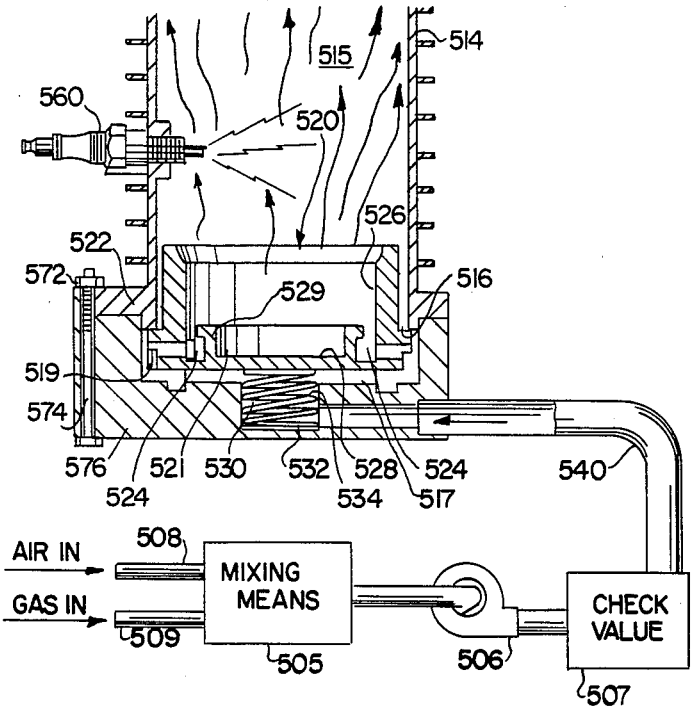
FIG. 2 is a cross-sectional view of another preferred embodiment of a power burner according the the present invention.
Figure 6:
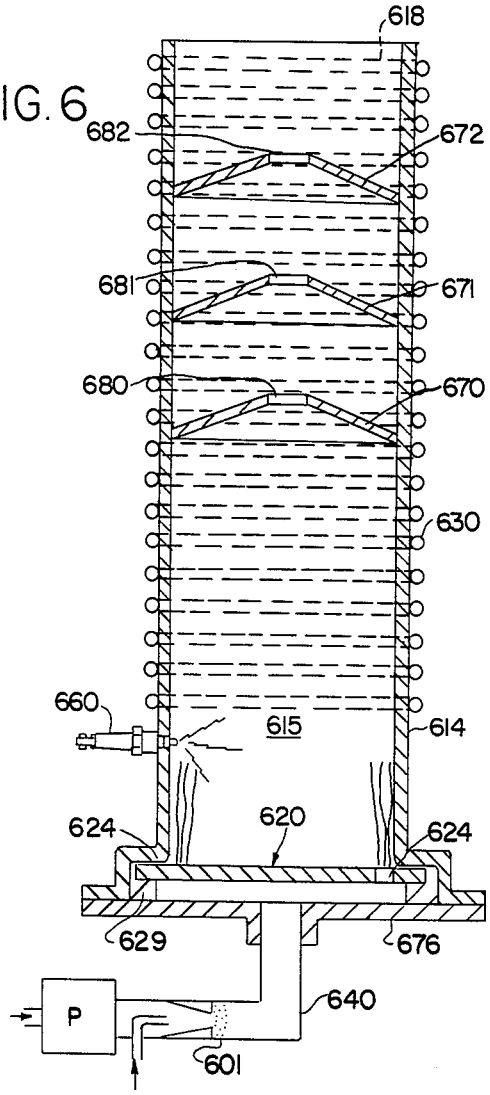
FIG. 6 is a cross-sectional side view of another embodiment of a power burner combustion device utilized as a fluid heating device.

If desired, the ball valve chamber may be deleted or replaced by a suitable conventional check valve (see FIG. 2). The ball valve chamber 34 or the check valve 507 may serve to prevent a flashback of the combustible mixture. Any suitable flame arrestor may be used, such as flame arrestor 601 as shown in FIG. 6. Contrary to many of the prior art patents, this invention may utilize a flame arrestor in the combustible mixture supply line rather than in the combustion chamber.

As shown in FIG. 1, ball valve chamber 34 and unvalved exhaust tube 50 have diameters which are considerably smaller than the cross-sectional diameter of the burner shell 14. Thus, the burner shell 14 is substantially closed on each end and has two restricted passageways: the ball valve chamber 34 at the inlet to the combustion chamber 15 and the exhaust tube 50 disposed at the exhaust end 18 of the burner shell 14. The burner shell 14, the ball valve chamber 34 and the exhaust tube 50 are all preferably made of a temperature resistant steel or other material which can tolerate the high temperatures generated in the combustion chamber while the combustible mixture is burning.

A flange 76 is secured, for example, by welding, to the end cap 17 to facilitate the assembly of the end cap 17 with the shell 14. A plurality of bolts 74 extend through openings in the flange and are threadably received by corresponding nuts 72 which may be secured, as by welding, to the shell 14. The end cap 17 is thereby detachably secured to the shell 14 by the nuts 72 and the bolts 74.

The open flow valve or distribution means 20 disposed in the burner or combustor shell 14 may be generally mushroom-shaped with an open interior or bore 26, as shown in FIG. 1. The open flow valve or disibution means 20 is preferably of integral construction and includes a base 27 having a first diameter and a tube 23 having a reduced diameter with bore 26 extending through the tube and through a portion of the base. A small clearance is provided between a side wall 25 of the base 27 and a side wall 19 of a base portion of the burner shell 14 to allow the combustible mixture to flow therethrough. The side wall 19 of the burner shell 14 is disposed between an annular shoulder portion 16 and the end cap 17 of the burner shell 14. The open flow valve or disribution means 20 is preferably made of a temperature resistant metal or other suitable material for high temperature use.

The open flow valve or distribution means 20 is disposed within the combustor shell 14 in open flow position by perforated washer 29 maintaining shoulder 22 in contact with shoulder 16 of the burner shell 14 while allowing combustible mixture flow from supply line 40 through ports 24 into combustion chamber 15. A plurality of ports 24 are disposed around shoulder 16 beneath shoulder 22 and provide communication between bore 26 and the small clearance between side wall 25 and the side wall 19. The combustible mixture may flow from ball valve chamber 34 through the space between base 27 and end cap 17, through openings in perforated washer 29, through ports 24, and through bore 26 to be distributed along the periphery of chamber 14. The controlled pressurized combustible mixture open flow power burner mode of operation may be readily converted to a pulsed combustion mode of operation simply by removal of perforated washer 29 to allow flotation of the valve with its extent of opening governed by pressures on opposite sides as more fully described in my earlier patents.

A spark plug 60 extends into the combustion chamber through a threaded bore in the combustor chamber shell 14. The spark plug 60 is provided to initially ignite the combustion gases in combustion chamber 15. The spark plug 60 is preferably threaded into the combustion chamber shell 14 so as to provide a seal between the spark plug 60 and the combustor shell 14. The spark plug 60 is disposed near open flow valve or distribution means 20.

The ball check valve provided in the combustible mixture supply line 40, as shown in FIG. 1, includes a smooth ball 30 arranged to be positioned toward and away from a rear seat 32 of the ball valve chamber 34. Various arrangements may be provided at a front end of the ball valve 34 such as fingers or a lattice to retain the ball 30 in the ball valve chamber 34 or there may be a spring between ball 30 and the bottom of open flow valve or distribution means 20 which is overcome by the force of the pressurized combustible gas. The ball valve 30 aids in prevention of backfire through the supply line 40 by preventing a flame in the combustion chamber 15 from spreading backwardly into the combustible mixture supply line 40. If desired, additional or different backfire prevention devices, such as a suitable conventional check valve or other type of flame arrestor, could be provided in supply line 40 upstream of the ball valve 34 or instead of the ball valve 34.

The exhaust tube 50 at the exhaust end 18 of the burner shell 14 has a first end 51 disposed inside the burner shell 14 and a second end 52 disposed outside the burner shell 14. The exhaust tube 50 is relatively small in cross-sectional diameter with respect to the burner shell 14. The burner shell 14 preferably has a sloping or curving exhaust end surface 12 which slopes inwardly toward the exhaust tube 50 and with the tube 50 preferably ending at, or perhaps extending only slightly through, a central portion of the end surface 12. If the inner end of the exhaust tube 50 protrudes too far nnto the combustion chamber 15, the efficient operation of the combustion chamber may be interrupted. It is preferable, however, to have the end surface 12 curved or sloping to provide a tornadic action which is believed to cause intense heat and complete combustion of the combustible mixture and therefore a more efficient use of the fuel within the combustor.

It is to be noted that the exhaust tube 50 may be adjusted in size and location to adjust the exhaust flow from the combustion chamber. By adjusting the exhaust tube 50, the desired operating characteristics of the burner namely, the number of pulses per minute when used as a pulse combustor, the pressure in the combustion chamber 15, the velocity of the gas exhausted and other such factors ay be optimized for highly efficient thermal transfer through combustion chamber shell 14. For example, if the tube diameter is too large, the residence time of combustible gases may not be sufficient for complete combustion and efficient heat transfer, and if too small, the maximum combustion cannot take place. Adjusting the exhaust tube for pulse combustion provides the desired size and geometry for use of the same apparatus as a controlled pressurized combustible mixture power burner. However, the supply of combustible mixture may be modified 4 or 5 times while maintaining efficient combustion in the same unit.

Generally it can be stated that the burner shell 14 is considerably larger in diameter than the exhaust tube 50. The appropriately sized exhaust tube 50 is rigidly secured to the combustion chamber 14, preferably by welding. The appropriate relative dimensions for the shell 14, the exhaust tube 50 and the open flow valve or distribution means 20 will be readily determined experimentally by one skilled in the art upon reading the present specification for both the power burner and the pulsing combustion mode of operation of the same apparatus. Specifically, in each embodiment, it is recommended that values for all but one of the variables be preselected with the remaining variable sized according to the preferred operation of the device.

During operation, a controlled pressurized combustible mixture is supplied to the bottom of open flow valve or distribution means through the combustible mixture supply line 40 by way of the ball valve chamber 34. The combustible mixture is preferably an air and gas combination with the gas preferably being either natural gas or propane although pure ethane, pure methane or other combustible gases would also suffice. Since the power burner of this invention is a controlled pressurized combustible mixture supply apparatus and process, combustion air may be supplied from any suitable source, such as air from outside the building to be heated, thereby providing a sealed power burner. The power burner of this invention provides highly efficient combustion with less than 20 percent excess combustion air and, preferably less than 15 percent excess combustion air. Gas and air are mixed through a suitable conventional valving system, from an air compressor, and a source of fuel gas, not illustrated, in a suitable, conventional manner to form the combustible mixture which is supplied to the combustible mixture supply line 40 at pressures of about 1 to about $3\frac{1}{2}$ inches water column. A preferred manner of control and mixing the combustible mixture is shown in FIG. 13 and the accompanying description in my allowed U.S. patent application Ser. No. 785,433, now U.S. Pat. No. 4,637,792.

The pressurized combustible mixture initially lifts the ball valve 30 from its seat 32 in the ball valve chamber so that the combustible mixture can flow around the ball valve 30 into the small clearance between the open flow valve or distributor means side wall 25 and the side wall 19 of the shell 14. The combustible mixture may then flow through the ports 24 into the combustion chamber by way of the bore 26 and is directed along the periphery of combustion chamber 15. In the power burner mode of operation, perforated washer 29 maintains open flow valve and distribution means in its extreme open position against shoulder 16 of combustion chamber shell 14. Simple removal of perforated washer 29 allows valve 20 to float and pulse combustion may be performed in the same apparatus in a manner described in my earlier patents.

The plurality of ports 24, which are arranged radially communicate with the bore 26. The ports 24 extend into the bore 26 to provide a path of flow for the combustible mixture. The size and the number of the ports 24 depends upon the type of fuel used and the pressure at which the combustible mixture is supplied.

The combustible mixture enters the combustion chamber only through the ports 24 and thus, the end of tube 23 of open flow valve 20 and distribution means serves as a flame holder or flame tube to contain the hollow flame generated by the burning of the combustible mixture.

Figure 3:
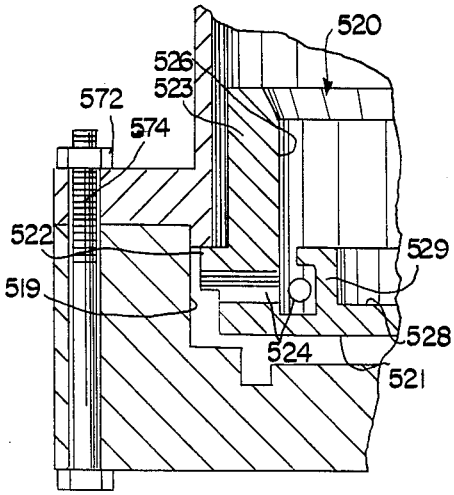
FIG. 3 is an enlarged view of a portion of the power burner of FIG. 2.

With reference now to FIGS. 2 and 3, another preferred embodiment of a heating device according to the present invention includes the power burner combustion device as generally described in connection with FIG. 1 but with some modifications. An elongate, cylindrical combustion chamber shell or burner shell 514 defines a combustion chamber 515 with the combustion chamber shell 514 generally tubular with a length that is considerably greater than its width. An end cap 576 is disposed at an inlet end of the combustor shell 514 with the inner surface of end cap 576 together with the bottom surface 521 of open flow valve and distribution means defining a path for passage of incoming combustible gases through the space 517 and through ports 524 in the open flow valve and distribution means 520 to the combustion chamber 515. After combustion, the combustion gases exit through an exhaust tube disposed at the opposite exhaust end of the combustor shell 514. The combustion chamber 515 is closed except for the outlet for controlled passage of combustion gases and the inlet for controlled admission of the combustible mixture.

The combustible mixture is formed in a mixing chamber means 505 which is supplied with air through conduit 508 and combustible gas through conduit 509. The power burner of this invention operates with high efficiency with less than 20 percent and preferably less than 15 percent excess combustion air. The combustible mixture is then supplied to a pumping mechanism 506 which pressurizes the combustible mixture to about 1 to about 3½ and preferably about 1 to about 2½ inches water column as it enters the combustion chamber. Since the mixture is, of course, highly flammable., the pumping mechanism 506 must be appropriately protected against electrical discharges and other disturbances which might ignite the mixture.

The pumping mechanism 506 may discharge the combustible mixture at a constant rate or as a series of discrete pulses at a desirable rate. A typical rate of discharge is about 3000 pulses per minute. An automobile emission system pollution control pump ("smog" pump) has been successfully utilized experimentally to pressurize the combustible mixture in discrete pulses. Such a pump generally has two vanes and rotates at 1500 rpm. Suitable low pressure pumps may be used to obtain the low pressures referred to above.

The combustible mixture is then passed through a suitable, conventional check valve 507 and then immediately into a supply line 540. The distance between the pumping mechanism 506 and the power combustion device is appropriately short and is preferably not provided with baffles or large chambers so as to maintain the "pulsed" nature of the supply to the extent possible, when used. The combustible mixture is supplied by supply line 540 through a passageway 534 to passageways 517. The passageway 534 includes chamber 532 having power combustion spring 530 which maintains open flow valve or distribution means 520 in full open position, against shoulder 522 during combustion. For conversion of the burner of this embodiment from the power burner mode to the pulsing combustion mode, a weaker spring replaces the power combustion mode spring to accommodate the desired movement of valve means 520 in a floating condition as described in my prior patents for pulsed combustion.

The inner face of the end cap 576 includes an annular channel which communicates with the chamber 532 by way of four radial slots 517. The radial slots 517 are arranged in the shape of a cross. A flange is secured, for example, by welding, to the end cap 576 to facilitate the assembly of the end cap 576 with the shell 514. A plurality of bolts 574 extend through openings in the flange and are threadably received by corresponding nuts 572 which may be secured, as by welding, to the shell 514. A sealing gasket, not shown, preferably of neoprene or another gasket material suitable for high temperature use may be preferably disposed between the end cap 576 and the lower end wall of the burner shell 514.

The end cap preferably has four holes for receiving the bolts 574. In this way, two of the bolts may be used to join the end cap and the burner shell together and the remaining two bolts may be used to mount the combustion device in the furnace or other location of operation.

As discussed more fully below, the controlled pressurized combustible mixture power burner combustion device according to the present invention need not be arranged vertically with the flame burning upwardly, but instead can be mounted horizontally or inverted or in any suitable configuration.

The open flow valve and distribution means 520 is generally mushroom-shaped with an open interior or bore 526, see also FIG. 3. A base 522 has a first diameter and a tube 523 having a reduced diameter with the bore extending through the tube and through a portion of the base. A plurality of ports 524, such as sixteen in number, extend through the base beneath shoulder 522 and provide communication between bore 526 and the small clearance between the side wall of the base and the side wall 519. Preferably, the open flow valve and distribution means is recessed immediately beneath the outer end of the ports 524 around the entire periphery. In this way, communication with the ports is more easily obtained.

A diffuser ring 529 extends upwardly from the base to define a cup 528. The diffuser ring 529 is generally shaped as an inverted "L" in cross section, see FIG. 3, and defines an annular chamber which forms an extension of the ports 524. The annular chamber directs the combustible mixture upwardly along the inner wall 526 and combustion chamber shell 514 to promote the hollow peripheral flame and to enhance heat exchange through combustion chamber shell. The use of the diffuser ring 529 has also resulted in nearly instantaneous ignition upon firing of the spark plug 560.

As in the embodiment of FIG 2, a spark plug 560 extends into the combustion chamber through a threaded bore in the combustor chamber shell 514 and is provided to initially ignite the combustion gases within the shell 514.

The check valve 507 is provided in the line 540 to prevent backfire through the supply line 540 by preventing a flame in the combustion chamber 515 from spreading backwardly into the combustible mixture supply line 540. If desired, additional or different backfire prevention devices could be provided.

The exhaust tube at the exhaust end of the burner shell 514 has a first end disposed at the exhaust end surface of the burner shell 514 and a second end disposed outside the burner shell 514. The exhaust tube is relatively small in cross-sectional diameter with respect to the burner shell 514.

The outer surface of the burner shell 514 is preferably provided with a plurality of suitable, conventional vanes which facilitate a heat exchange with the surrounding air. In addition, the exhaust pipe may communicate with an inner heat exchange coil and an outer heat exchange coil by way of a T-fitting. The inner and outer heat exchange coils each encircle the burner shell 514 to provide an efficient and compact configuration and so as to effectively transfer heat to the surrounding air. The exhaust gases from the inner and outer coils may then be recombined and are supplied to a suitable conventional exhaust.

Figure 7:
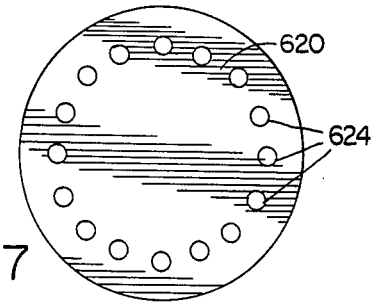
FIG. 7 is an enlarged top view of a valve or distribution means shown in the power burner combustion device shown in FIG. 6.
Figure 8:
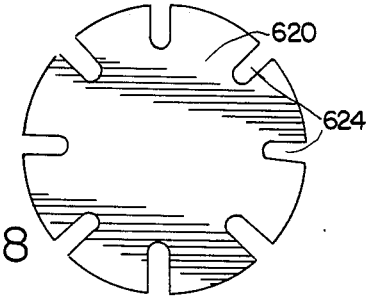
FIG. 8 is a top view of another embodiment of a valve or distribution means suitable for use in a power burner combustion device of this invention.

FIG. 6 shows, in simplified somewhat schematic form, another embodiment of a power combustion burner according to this invention. Combustion chamber shell 614 defines combustion chamber 615 with end cap 676 at the inlet end. Open flow valve and distribution means 620 is a flat plate with peripheral through openings 624 which may be in the form of holes as shown in FIG. 7 or in the form of open slots as shown in FIG. 8. Flat plate open flow valve and distribution means 620 is maintained in full open position against the shoulders at the end of combustion chamber walls 615 by solid washer-spacer 629 for operation as a power burner. Operation in the pulse combustion mode may be achieved by simply removing spacer 629. Preferably, the through openings 624 direct the combustible gases along the walls of combustion chamber 615 to provide a hollow, high combustion efficiency blue flame. This configuration also provides exceptionally high heat transfer through combustion chamber walls 614 due to the proximity of the flame to the heat exchange surface and due to scrubbing action by the combustible gases and flame action along the interior of walls 614 to reduce film heat transfer coefficients. To achieve high peripheral activity in combustion chamber 615, through openings may be at right angles to the plane of flat plate 620 or may be angled to direct the gaseous flow therethrough along combustion chamber walls 614. It is readily apparent that flat plate open flow valve and distribution means 620 may be used in any of the other embodiments of this invention.

Another feature shown in FIG. 6 is that combustion chamber shell 614 has open end 618 open to the atmosphere instead of closed end 18 with small unvalved exhaust tube 50 as shown FIG. 1. The embodiment shown in FIG. 6 has constriction baffles 670, 671 and 672 with exhaust ports 680, 681 and 682, respectively. The constriction baffles are preferably of conical shape as shown. I have found that two or three constriction baffles within combustion chamber 615 results in cleaner combustion in a smaller combustion chamber with increased heat transfer through combustion chamber shell 614. The exhaust ports in the constriction baffles must be tuned for the system geometry in the same manner as described above with respect to exhaust tube 50. The constriction baffles may be advantageously used with any of the embodiments described for power combustors, regardless of configuration of the open flow valve and distributor and with or without restricted exhaust tube 50, as shown in FIG. 1. Generally, 2 to about 6 constriction baffles may be used to achieve improved heat exchange with a more compact burner-heat transfer unit. To provide a shorter burner-heat transfer unit, the heat transfer portion may be folded.

Heat removal from combustion chamber walls 614 as shown in FIG. 6 may be effected by any suitable means, including those described above. Heat exchange liquid coil 630 is shown in FIG. 6 as exemplary of a suitable heat exchanger means.

Figure 5:
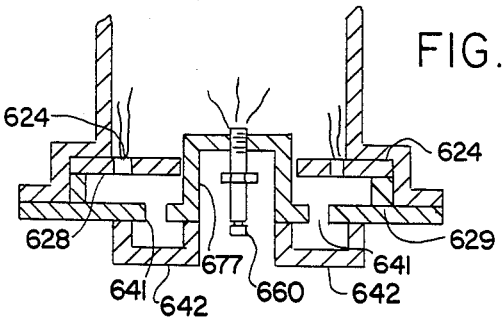
FIG. 5 is a sectional side view of the combustible gas mixing and feeing portion of another embodiment of a power burner of this invention.

Likewise suitable for use in all embodiments previously described in my patents and in this disclosure are advantageous embodiments wherein the open flow valve and distribution means, preferably the flat plate, may be as shown in FIG. 5 is in the form of annular plate 628 having through holes 624 and the combustible gas inlet is in the form of a plurality of inlets 641 supplied by gas manifold 642 around a corresponding annular area in the end cap 676. The annular structure of the end cap may have a hollow cylindrical portion 677 extending into the combustion chamber with a solid end a short distance into the combustion chamber from the inner surface of plate 628 and having the ignition means 660 extending therethrough. For example, a spark plug or other ignitor may be placed through the solid end of the cylindrical portion of the end cap extending into the combustion chamber. This location for the ignitor provides ignition more evenly to the hollow flame.

Figure 4:
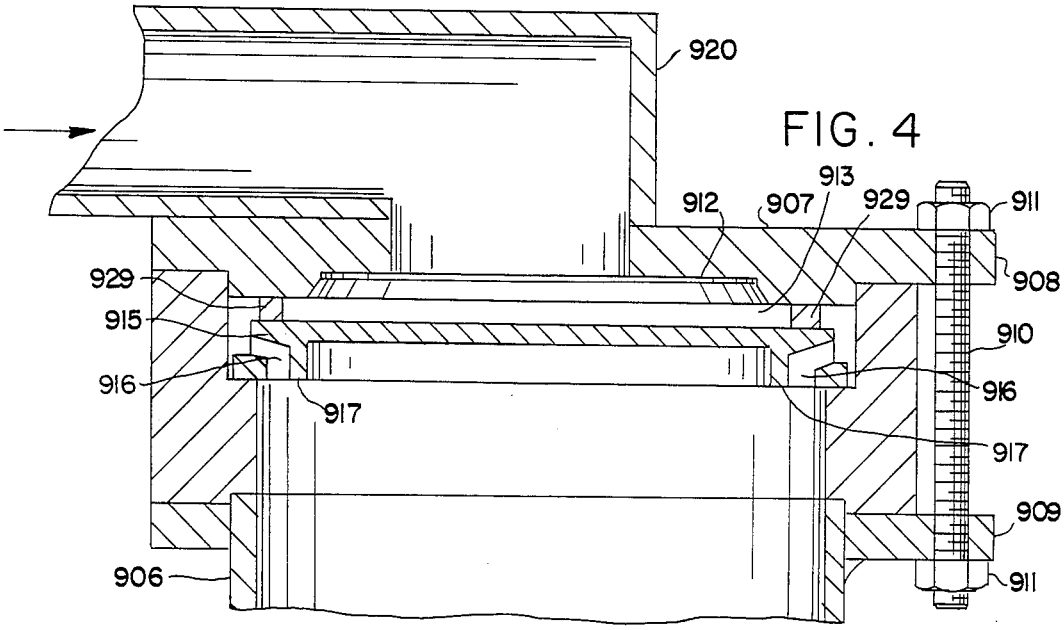
FIG. 4 is a sectional view of the combustible gas mixing and feeding portion of another embodiment of an apparatus of this invention.

Another embodiment of this invention is shown in FIG. 4 wherein combustible gas mixture is supplied through supply line 920 to combustible gas inlet chamber 912. Open flow valve or distribution means 915 has combustible gas feed bores 916 in communication from chamber 913 to combustor chamber 906 wherein combustible gas feed director flange 917 directs the combustible gas along the periphery of combustor chamber 906. Ring 929 holds open flow valve and distribution means 915 in full open position and is perforated to permit unobstructed gas flow from supply line 920 to gas feed bores 916. Chamber 913 is defined by removable end piece 907 which is provided with holding flange 908 for secure fastening to combustor chamber 906 by assembly bolts passing through pulse combustor holding flange 909 and tightened with assembly nuts 911. Provision of the removable combustor end piece 907 facilitates changing of dimensions of combustible gas inlet chamber 912 and chamber 913 to accommodate different types of open flow valves and distribution means as have been described herein before, as well as for insertion of spacer ring 929 to utilize the combustor as a power combustor or removal of spacer ring 929 to use the combustor as a pulse combustor. The power combustor operates in the same fashion as previously described herein.

The controlled pressurized combustible mixture power burner of this invention may be used in hot water heaters or deep fat cooking devices in the same fashion as the pulse combustors of my prior applications and patents. Operation of the combustor by introduction of the combustible gas mixture downwardly from the top provides easier ignition starting of the combustor. The power combustor may be in a vertical position extending either downwardly or upwardly in the water tank, or may be in a horizontal position in the water tank.

Figure 11:
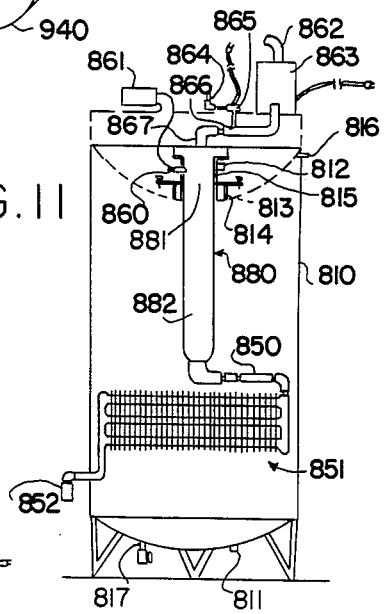
FIG. 11 is a cross section of one embodiment of a hot water heater utilizing a power burner combustion device according to this invention.

FIG. 11 shows one embodiment of a hot water heater of this invention utilizing a power burner of this invention. Water tank 810 has water inlet 811 and hot water outlet 812. The water tank top 813 may be depressed to provide mounting bracket 814 and outlet water jacket 815. Air bleed and safety means 86 is provided in an upper portion of the tank. Water drain means 817 may be provided as desired. A power burner of this invention 880 is mounted with its combustion zone 881 in the region of outlet water jacket 815 to provide direct heat transfer through the combustion chamber walls to water being withdrawn through hot water outlet 812. Heat transfer zone 882 of combustor 880 extends downwardly into the volume of water and combustion products exhaust tube 850 conveys combustion products for further heat transfer in finned heat transfer means 851 and the exhaust exits from the water heater through exhaust conduit 852 at relatively cool temperatures. Control components of the power burner 880 are schematically shown: spark plug 860 and suitable ignition power supply 861; air supply line 862 and compressor and metering means 863; gas supply line 864 and pressure and metering means 865; mixing means 866 for mixing air and gas and flashback arrestor 867 preventing ignition prior to combustion chamber 881. Any of the open valve distributor configurations and heat exchanger configurations described may be used in this embodiment.

Figure 12:
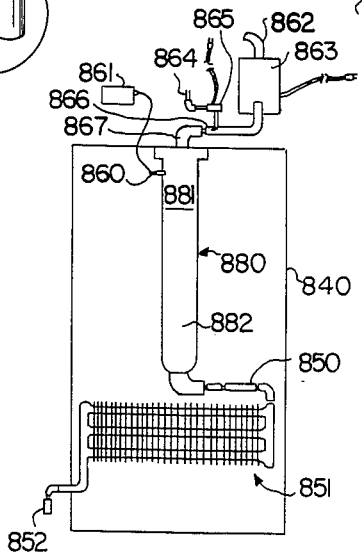
FIG. 12 is a top view of one embodiment of a deep fat cooker utilizing a power burner combustion device according to this invention.

FIG. 12 shows one embodiment of a deep fat fryer utilizing a power burner of this invention. Deep fat fryer tank 840 has power burner 880 mounted for direct heat transfer to liquid fat in tank 840. The remainder of the numbers and function of the power burner are as described with respect to the hot water heater of FIG. 11.

The power combustor of this invention is particularly well suited for use in air heating systems as described in my prior applications and patents. The power burner may be operated in either a horizontal, down-pass or up-pass mode.

Figure 9:
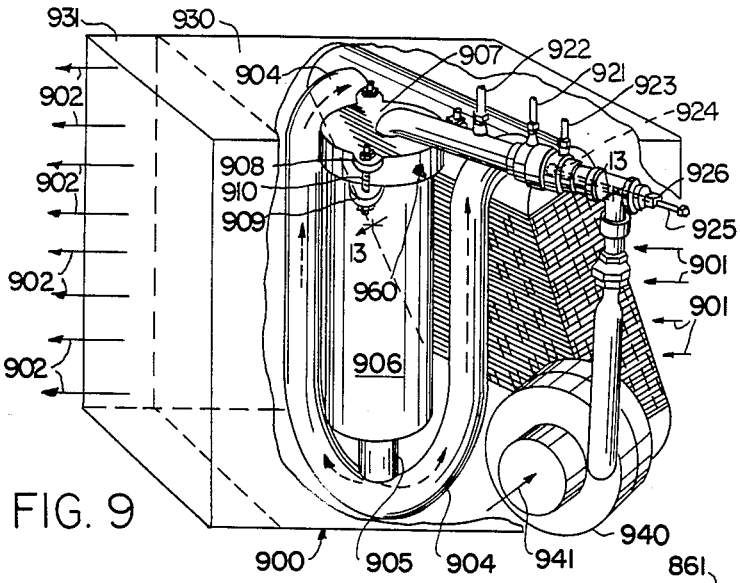
FIG. 9 is a perspective view of a hot air heater utilizing a power burner combustion device according to this invention.

FIG. 9 schematically shows one embodiment of a power burner of this invention used in an air heating system. FIG. 9, in simplified schematic form, shows air heater 900 wherein an air treatment passage is defined by air treatment duct 930 with cold air entering as shown by arrows 901 and leaving as heated air shown by arrows 902. The air to be heated, usually return air from an enclosed volume, such as a room, is driven through treatment duct 930 by an upstream blower, not shown, and first passed over heat exchanger 903 and then passed in direct contact with combustor chamber 906 and combustor exhaust manifold 904 and through treatment unit 931 comprising any desired humidification means and filtering means. The treatment air blower means, filter means and humidification means are not shown, but are any such suitable means as conventionally used in warm air furances as known to the art. Although shown in a horizontal air passage configuration, the entire assembly may be rotated 90° and operated in either a down-pass or up-pass mode. The power burner will operated in any of these positions.

As shown in FIG. 9, combustion air is provided through air intake 941 of combustion air blower 940 where it is pressurized to about 3½ to about 7 inches of water, preferably about 4 to about 6 inches of water. The combustion air pressure and flow rate is maintained and regulated by combustion air flow regulator shown generally as 924 in FIG. 9. Referring also to FIG. 4, combustion air flow regulator 924 has rod 925 with tapered heat 927 which fittingly engages tapered inlet 928. Combustion air flow regulator rod 925 is preferably threaded and is reaiily adjustable through a threaded bore in the T-shaped end of combustion air pressurized conduit 942. Suitably, lock nut 926 is provided to lock combustion air flow regulator rod 925 in desired position and if desired, bearing means may be provided within combustion air pressurized conduuit 942 to assure centering of tapered head 927 within tapered inlet 928. It is readily seen that as tapered head 927 is advanced into tapered intlet 928 the flow of pressurized combustion air is decreased and its pressure, assuming a constant speed combustion air blower 940, is increased.

Combustile fuel gas, such as natural gas, is introduced through gas supply line 921 into a mixing chamber downstream from combustion air flow regulator 924. Not shown in the drawing in gas supply line 921 is a suitable gas pressure controller, as is well known to the art, to provide fuel gas at a pressure of about 2 inches to 3½ inches of water and preferably about 3 inches to 3½ inches of water. High pressure air gas tap 923 is provided to monitor the pressure of combustion air prior to passage through tapered inlet 928 and may be provided with a safety switch which allows a gas valve in gas supply line 921 to open only after desired pressure is reached in combustion air pressurized conduit 942. Low pressure combustible mixture tap 922 is provided in combustible gaseous mixture supply line 920 for control purposes. I have found that using the high pressure combustion air supply as described in conjunction with power burner that there has been no tendency for flashback, however, safety codes may require that a spark arrestor be placed in combustible gaseous mixture supply line 920.

Figure 10:
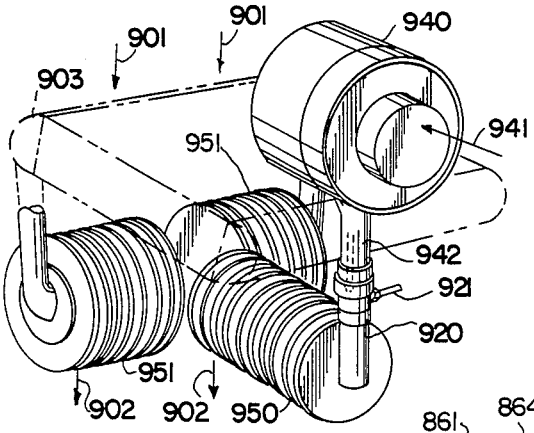
FIG. 10 is a perspective view of another embodiment of a hot air heater using a power burner combustion device according to this invention.

FIG. 10 schematically shows another embodiment of an air heater according to the present invention, wherein the cold air to be treated 901 is passed downwardly in sequence through heat exchanger 903 and finned pulse combustion chamber 950 and finned exhaust manifold 951 to exit as heated air shown by arrow 902. The embodiment shown in FIG. 10 operates in the same fashion as the embodiment shown in FIG. 9 except that the combustor chamber and the combustion exhaust manifold is provided with expanded heat exchange surfaces.

The controlled pressurized combustible mixture power burner combustor is preferably provided in a gas heat exchange configuration such as a conventional forced air furnace housing. The power burner combustor may be mounted for updraft, downdraft or crossdraft air flow with the air to be heated being flowed over the coils and over the burner shell. In this way, the air to be heated cools the burner shell to prevent overheating. The air to be heated is preferably driven over the coils and the burner shell by a suitable conventional blower with the power burner combustion device being mounted in a closed housing to direct the forced air over the coils and the burner shell. An advantage of the controlled pressurized combustible mixture power burner of this invention is that it can be used in a sealed mode of operation with respect to the treatment airstream and the enclosed space being heated. That is, outside air may be used for combustion air and flue gas may be vented to the outside. The power burner of this invention may also advantageously use inside air for combustion since less than about 20 percent excess air is required for efficient combustion, an amount much less than conventional furnaces. The power burner furnace of this invention with its high efficiency thermal transfer provides flue temperatures in the order of about 120° to 135° F. so that brick or tile chimney structures may not be necessary.

In a specific embodiment, a power burner in the form as shown in FIG. 4 was used in conjunction with a heat exchanger in the configuration as shown in FIG. 9. The combustible gas mixture inlet chamber was 2.125 inches high with a diameter of 4.875 inches and the combustion chamber was 11.625 inches in height with diameter of 4 inches providing a volume of 0.85 cubic feet. The primary heat exchanger, as shown in FIG. 9, comprises the combustion burner itself and a U-shaped tailpipe 30 inches long and 2.5 inches diameter which fed a secondary heat exchanger comprises a parallel plate, finned tube assembly of twenty-seven $\frac{5}{8}$ inch diameter stainless steel tubes in three rows between headers, measuring 14 inches in width by 22 inches in length. A combustible gas mixing system as shown in FIG. 4 was used. In power burner mode of operation, thermal efficiencies of over 90 percent were obtained with treatment airflow of 900 CFM at inputs of 37,000–50,000 Btu/hr. The flue temperature at the inlet to the secondary heat transfer manifold was 620°–630° F. indicating high thermal transfer between the combustor-tailpipe and the treatment airstream representing thermal efficiencies of about 72–74 percent. The flue temperature at the outlet of the secondary heat exchanger was 123° F. while the ambient temperature was 76° F., representing thermal efficiencies of about 90 percent. The flue gas $CO_2$ content was 8–10 percent, CO 3–15 ppm, and $O_2$ 2–7 percent with excess combustion air of 9 to 40 percent. The pressure in the high pressure supply manifold prior to mixing of fuel and combustion gas was 6.4 inches water and in the low pressure supply manifold after forming the combustible mixture was 2.4 inches water. When the same burner was operated in the pulse mode, similar results were obtained.

In the power combustors of this invention the flame is a steady continual flame generally attached to the upper side of the open flow valve or distribution means which serves as a flame holder limiting combustion to a hollow combustion zone adjacent the open flow valve or distribution means. The combustion obtained by the power combustor of this invention results in a steady continual high temperature, 2000° to over 2500° F. clean burn blue flame. The fuel efficiency in the combustor of this invention may be in excess of 95 percent and preferably in excess of 96.5 percent. The small size and geometry of the combustor unit and the hollow flame together with the scrubbing action of the flame and gases along heat transfer surfaces provides exceptionally high heat transfer through the combustor walls. The power combustor of this invention provides a clean, cool combustion product stream which may be vented through a small tube without the need for a conventional chimney.

While some specific dimensions have been set forth, a wide variety of sizes of combustors according to this invention for various applications have been operated, for example, having combustion chambers up to 8 inches in diameter and 48 inches in length with combustible gas inputs of up to 412,000 Btu per hour. Higher gas inputs are feasible in larger units. While various embodiments showing convertibility of the combustor unit from pulsed combustion mode to power combustion mode have been described, it should be appreciated that my invention also includes any means of fixing the open flow valve or distributor in open flow position, such as by welding.

The power combustor of this invention may be used to provide the advantages of high efficiency energy utilization, both in increased fuel efficiency in combustion and in thermal transfer of heat from the combustion products. These high efficiencies result in small physical size combustors suitable for a wide variety of heating applications, such as for heating gases, liquids or solids such as industrial or home space heating, industrial or home hot water boilers and hot water heaters, chemical process heating, deep fat fryers, cooking griddles and other heating appliances and processes.

While in the foregoing specification this invention has been described in relation to certain preferred embodiments thereof, and many details have been set forth for purpose of illustration, it will be apparent to those skilled in the art that the invention is susceptible to additional embodiments and that certain of the details disclosed herein can be varied considerably without departing from the basic principles of the invention.

I claim:

1. A power combustion advice comprising:

means for defining an elongate combustion chamber having an inlet for a combustible mixture and an unvalved outlet open to the atmosphere for combustion gases;

an open flow valve distributor member mounted in a wall of said combustion chamber, means retaining said open flow valve distributor member in open flow position, said open flow valve distribution member having a first side in communication with said combustion chamber and a second side in communication with a controlled supply of a pressurized combustible mixture and having a plurality of ports through said valve member, means for directing said combustible mixture along the periphery of said combustion chamber;

means for supplying a controlled pressurized combustible mixture to said second side of said open flow valve distribution member; and means for igniting and combusting said combustible mixture in said combustion chamber.

2. A power combustion device of claim 1 wherein said means for supplying said controlled pressurized combustible mixture is capable of supplying said combustible mixture at pressures about 1 to about $3\frac{1}{2}$ inches water column.

3. A power combustion device of claim 1 wherein said open flow valve distributor member is a flat plate having a plurality of peripheral through openings.

4. A power combustion device of claim 1 wherein said open flow valve distributor member is a flat annular plate having a plurality of peripheral through openings.

5. A power combustion device of claim 1 wherein said elongate combustion chamber has at least one constictor plate having an exhaust port with a cross section relatively small with respect to the cross seciton of said combustion chamber located across said combustion chamber above the zone of combustion.

6. A power combustion device of claim 1 wherein said elongate combustion chamber extends into a water heater tank providing direct heat transfer therewith.

7. A power combustion device of claim 1 wherein said elongate combustion chamber extends into a deep fat cooker tank providing direct heat transfer therewith.

8. A power combustion device comprising: means for defining an elongate combustion chamber having an inlet for a combustible mixture and an unvalved outlet open to the atmosphere for combustion gases; an open flow valve distributor member in a wall of said combustion chamber, means retaining said open flow valve distributor member in open flow position, said open flow valve distribution member having a first side in communication with said combustion chamber and a second side in communication with a controlled supply of a pressurized combustible mixture and having a plurality of ports through said valve member, means for directing said combustible mixture along the periphery of said combustion chamber; means for supplying a controlled pressurized combustible mixture to said second side of said open flow valve distribution member; and means for igniting and combusting said combustible mixture in saidd combustion chamber; said power combustion device mounted within air treatement duct and having said unvalved outlet leading into an exhaust manifold means in gas flow communication with one end of a closed heat exchanger means, the other end of said closed heat exchange means open to said atmosphere, all situated within said air treatment duct; blower means for passage of cold air to be heated through said air treatment duct and in thermal exchange with said heat exchange means and said combustion chamber and exhaust manifold, providing heated air.

9. A power combustion device of claim 8 wherein said means for supplying said controlled pressurized combustible mixture is capable of supplying said combustible mixture at pressures about 1 to about 3½ inches water column.

10. A power combustion device of claim 8 wherein said open flow valve distributor member is a flat plate having a plurality of peripheral through openings.

11. A power combustion device of claim 8 wherein said combustion chamber and said exhaust manifold have extending fins providing higher heat exchange.

12. A power combustion device comprising: means for defining an elongate combustion chamber having an inlet for a combustible mixture and an unvalved outlet open to the atmosphere for combustion gases; an open flow valve distributor member mounted in a wall of said combustion chamber, means retaining said open flow valve distributor member in open flow position, said open flow valve distribution member having a first side in communication with said combustion chamber and a second side in communication with a controlled supply of a pressurized combustible mixture and having a plurality of ports through said valve member, means for directing said combustible mixture along the periphery of said combustion chamber; means for supplying a controlled pressurized combustible mixture to said second side of said open flow valve distribution member; and means for igniting and combusting said combustible mixture in said combustion chamber; said power combustion device further comprising combution air blower means to supply a controlled amount of pressurized combustion air to a pressurized combustion air conduit at about 3½ to about 7 inches water, a combustio airflow regulator means at one end of said pressurized combustion air conduit controlling combustion airflow to a combustible mixture chamber, means for supplying fuel gas at a pressure of about 2 inches to about 3½ inches water to said mixing chamber, and combustible gaseous mixture supply line means for supplying controlled pressurized combustible mixture from said mixing chamber to said second side of said open flow valve distribution member at a pressure of about 1 to about 3½ inches water.

13. A power combustion device of claim 12 additionally having a high presure tap in said pressurized combustion air conduit, a low pressure tap in said combustible mixture supply line, and control means opening said means for supplying fuel gas only after said pressure is reached in said pressurized combustion air conduit.

14. A power combustion device of claim 12 wherein said combustion air flow regulator is adjustable.

15. A power combustion device of claim 12 wherein said means for supplying said controlled pressurized combustible mixture is capable of supplying said combustible mixture at pressures about 1 to about 3½ inches water column.

16. A power combustion device of claim 12 wherein said open flow valve distributor member is a flat plate having a plurality of peripheral through openings.

17. A power combustion device of claim 12 having a combustion air blower means capable of supplying less than about 20 percent excess combustion air.

18. A combined pulsing power combustion device comprising: means for defining an elongate combustion chamber having an inlet for a controlled pressurized combustible mixture and an unvalved outlet open to the atmosphere for combustion gases; a valve distribution member mounted in reciprocation relation in a wall of said combustion chamber for pulsing mode and engagement means for fixing said valve distribution member in open flow for power mode, said valve distribution member having a first side in communication with said combustion chamber and a second side in communication with a supply of a controlled pressurized combustible mixture and having a plurality of ports through said valve member, means for directing said combustible mixture along the periphery of said combustion chamber; said reciprocation of said valve distribution member in said pulsing mode closing and opening communication through said ports between said supply of controlled pressurized combustible mixture and said combustion chamber and said engagement means fixing said valve distribution means in said power mode in open flow relation; means for supplying a controlled pressurized combustible mixture to said second side of said valve distribution member; and means for igniting and combusting said combustible mixture in said combustion chamber.

19. A power combustion device of claim 18 wherein said means for supplying said controlled pressurized combustible mixture is capable of supplying said combustible mixture at pressures about 1 to about 3½ inches water column.

20. A power combustion device of claim 18 wherein said open flow valve distributor member is a flat plate having a plurality of peripheral through openings.

* * * * *